United States Patent [19]

Kristof et al.

[11] Patent Number: 5,064,361

[45] Date of Patent: Nov. 12, 1991

[54] ROTATING PNEUMATIC VANE MOTOR WITH AIR BEARING

[75] Inventors: Michael Kristof, Bretten-Diedelsheim; Josef Mueller, Knittlingen, both of Fed. Rep. of Germany

[73] Assignee: Schmid u. Wezel, Maulbronn, Fed. Rep. of Germany

[21] Appl. No.: 505,221

[22] Filed: Apr. 5, 1990

[30] Foreign Application Priority Data

Apr. 27, 1989 [DE] Fed. Rep. of Germany ..... 3913908

[51] Int. Cl.[5] ..... F01C 1/344

[52] U.S. Cl. ..... 418/173; 418/270; 384/118

[58] Field of Search ..... 418/173, 270; 384/114, 384/118

[56] References Cited

U.S. PATENT DOCUMENTS

| | | | |
|---|---|---|---|
| 1,727,718 | 9/1929 | Kinsey | 418/270 |
| 2,884,282 | 4/1959 | Sixsmith | 384/118 |
| 2,918,877 | 12/1959 | Woodcock | 418/173 |
| 4,197,061 | 4/1980 | Hill | 418/270 |

FOREIGN PATENT DOCUMENTS

| | | |
|---|---|---|
| 0131158 | 1/1985 | European Pat. Off. . |
| 0137853 | 4/1985 | European Pat. Off. . |
| 1751379 | 7/1971 | Fed. Rep. of Germany . |
| 2621486 | 12/1977 | Fed. Rep. of Germany . |
| 59-192888 | 11/1984 | Japan . |
| 61-268892 | 11/1986 | Japan . |
| 1-35094 | 2/1989 | Japan . |

*Primary Examiner*—Richard A. Bertsch
*Assistant Examiner*—David L. Cavanaugh
*Attorney, Agent, or Firm*—Foley & Lardner

[57] ABSTRACT

A compressed-air vane motor comprises a rotor which is mounted on anti-friction bearings and has, distributed over the periphery, location slots in which vanes are guided in a radially displaceable manner and whose outer sealing edges bear by centrifugal force against the inner surface of the cylindrical outer shell. To reduce wear and friction, and to achieve a long service life when operating with oil-free compressed air, the outer shell, which is displaced eccentrically relative to the rotor, is rotatably guided in a housing and is driven along by the friction between the vanes and the outer shell, and the cylindrical outer shell is rotatably mounted in the housing by at least one air bearing and to this end is accommodated with little radial clearance in an approximately circular-cylindrical guide bore of the housing. In order to further reduce wear, at least one air pocket is provided and is open toward the outer shell in the housing. The axial length of this air pocket corresponds to the axial length of the encircling outer shell.

21 Claims, 4 Drawing Sheets

ROTATING PNEUMATIC VANE MOTOR WITH AIR BEARING

BACKGROUND OF THE INVENTION

The invention relates to a compressed-air vane motor comprising a rotor which is mounted on antifriction bearings and has, distributed over the periphery, location slots in which vanes are guided in a radially displaceable manner and whose outer sealing edges bear by centrifugal force against the inner surface of a cylindrical outer shell To reduce wear and friction in this arrangement, the outer shell, displaced eccentrically relative to the rotor, is rotatably guided in the housing and is driven along by the friction between vanes and outer shell, and the cylindrical outer shell is rotatably mounted in the housing by at least one air bearing and to this end is accommodated with little radial clearance in an approximately circular-cylindrical guide bore of the housing.

The service life of such a compressed-air vane motor disclosed by German Offenlegungsschrift 2,621,486 is limited. A fairly reasonable service life can only be achieved if oil mist is added to the compressed air. For the drive of hand tools, however, the oil mist coming out of the hand tool is troublesome. In many areas, in particular in the foodstuffs industry, use of such compressed-air vane motors therefore has to be ruled out.

In the compressed-air vane motor disclosed by German Patent Specification 1,751,379, the outer shell is rotatably mounted via anti-friction bearings. Despite this efficient bearing arrangement and guidance, relatively heavy wear occurs between the outer shell and the vanes on account of deficient lubrication of the bearing so that, when operating with oil-free compressed air, the vane motor can only achieve a short service life.

SUMMARY OF THE INVENTION

One object of the present invention is to provide a compressed-air vane motor of the type mentioned at the beginning in which oil-free compressed air is used and in which, the compressed-air vane motor has a long service life.

In accomplishing this object, there has been provided according to the invention, a compressed-air vane motor comprising a housing having a generally cylindrical guide bore located therein. The motor further comprises a rotor rotatably mounted on anti-friction bearings within the housing and a cylindrical outer shell eccentrically encircling the rotor and rotatably mounted within the guide bore via an air bearing means. The air bearing means preferably comprises a slight axial clearance between the outer surface of the axial shell and the guide bore. The guide bore is widened on one side along the axial length of the outer shell to form an air pocket between the housing and outer shell. Vane means are displaceably mounted in location slots of the rotor and are adapted to bear by centrifugal force against an inner surface of the outer shell and to rotate the outer shell within the guide bore due to frictional forces therebetween. These vane means may consist of rectangular vanes having sealing edges engaging the inner surface of the outer shell.

According to a further aspect of the invention, the outer shell has first and second axial end faces extending perpendicularly from the rotational axis thereof and which are guided with slight clearance between respective sealing faces of first and second sealing members. At least one of an air-inlet channel and an air-outlet channel open out in at least one of these sealing faces. Furthermore, the air-inlet channel is connected to the air pocket.

According to this aspect, the first sealing member consists of a bearing part and the second sealing member comprises a sealing disk which rotates with the rotor. This sealing disk may have a first face which bears against a shoulder of the rotor to form a sealing face and a second face which forms an axial bearing for the rotor and which has a collar extending therefrom which is restrained by an inner ring of one of the anti-friction bearings.

According to a still further aspect of the invention, the air pocket may be formed by a partial cylindrical surface of the guide bore which is eccentric relative to the remainder of the guide bore. The radius of curvature of the air pocket according to this aspect should be less than, or at most, equal to the radius of curvature of the remainder of the guide bore.

Other objects, features and advantages of the present invention will become apparent to those skilled in the art from the following detailed description. It should be understood, however, that the detailed description and specific examples, while indicating preferred embodiments of the present invention, are given by way of illustration and not limitation.

DETAILED DESCRIPTION OF THE PREFERRED EMBODIMENTS

Figure 1:
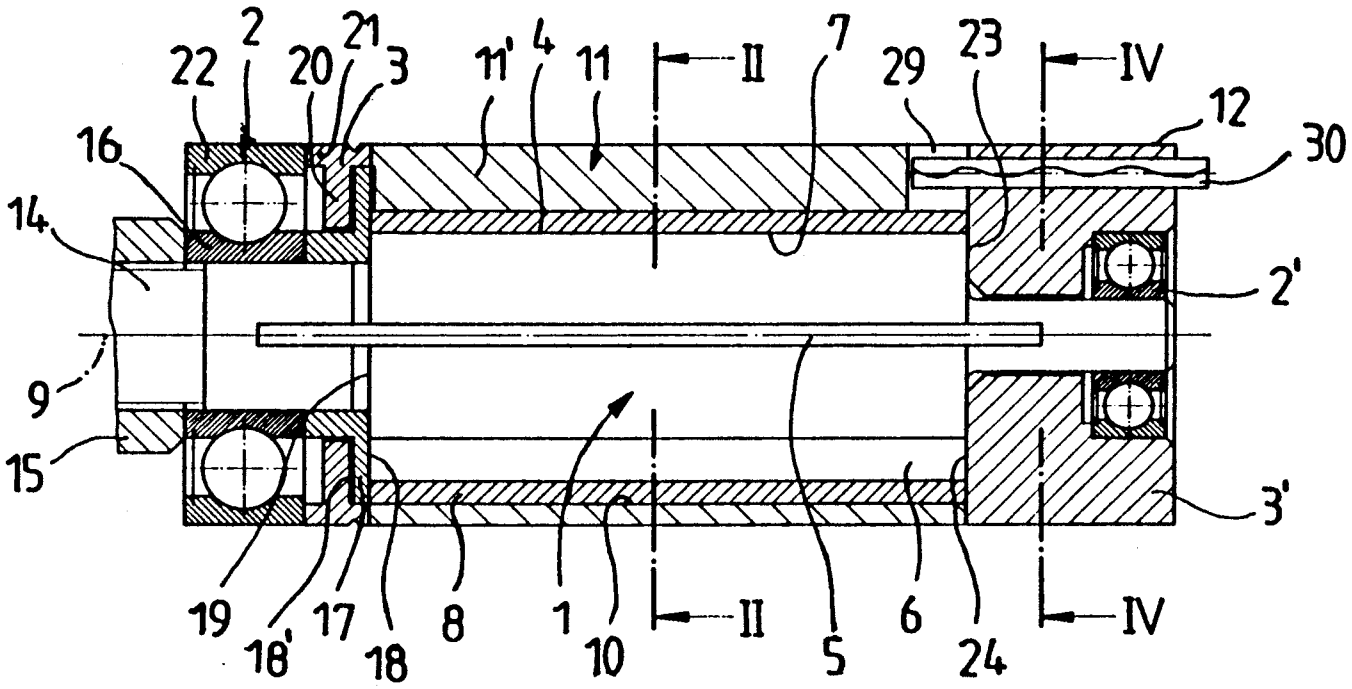
FIG. 1 is a longitudinal section through a compressed-air vane motor.
Figure 2:
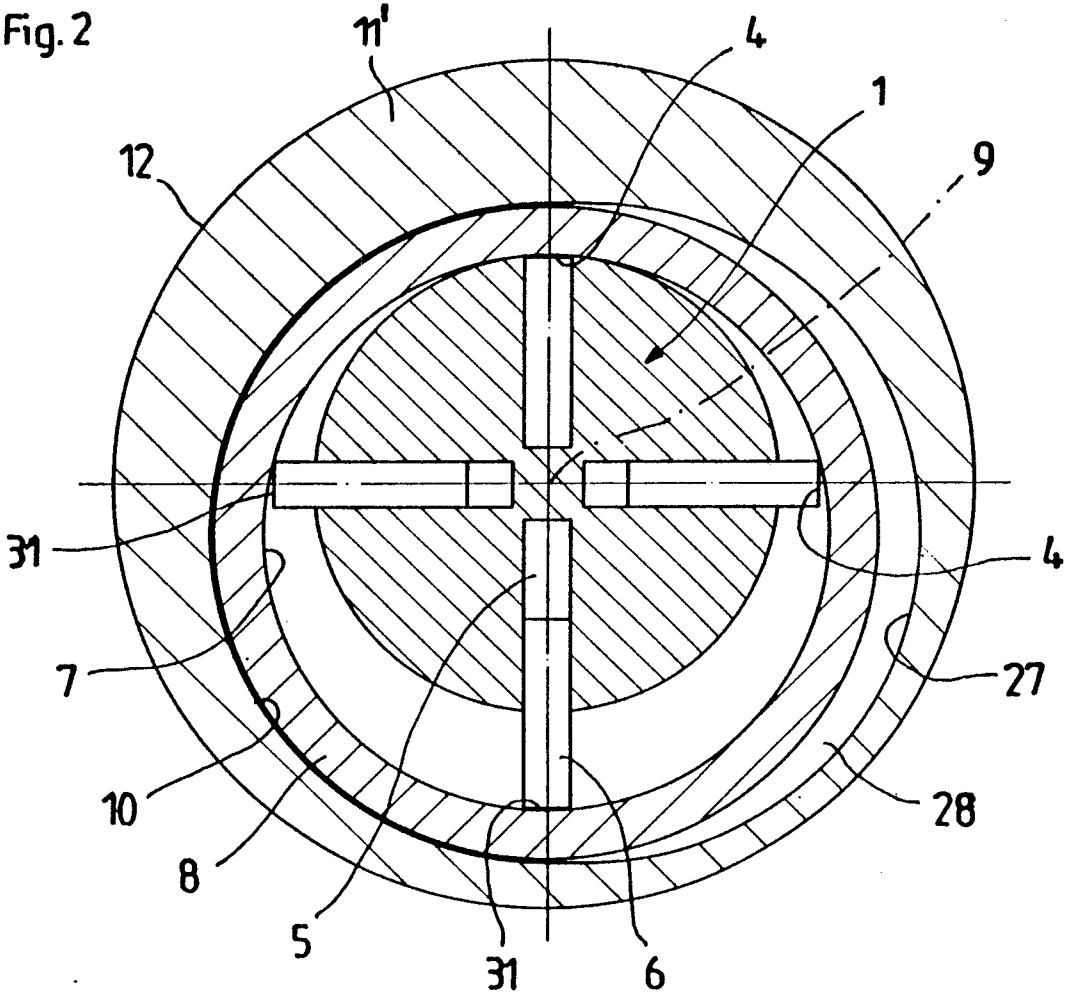
FIG. 2 is a cross-section along line II—II in FIG. 1 approximately in the center of the rotor to an enlarged scale.
Figure 3:
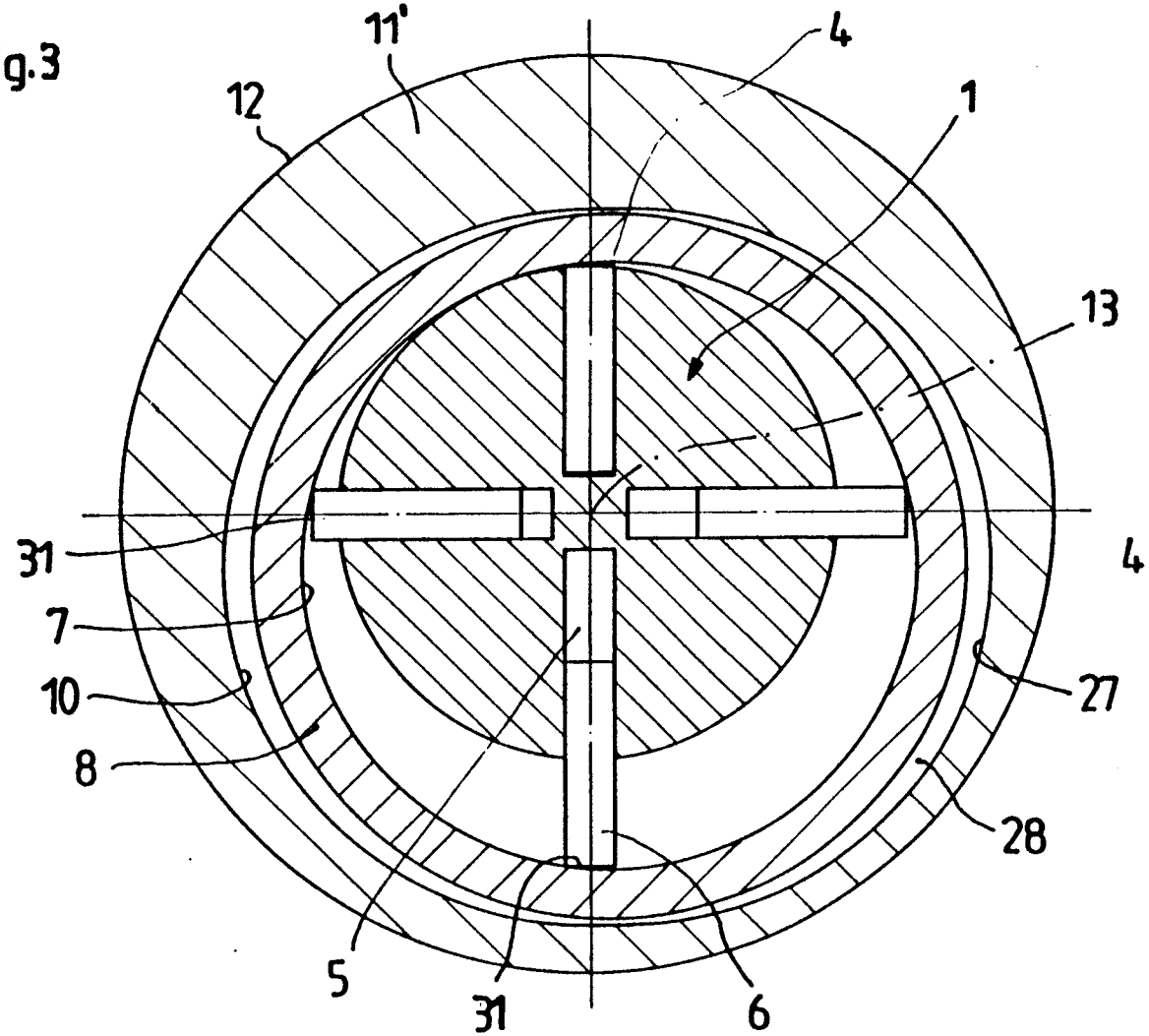
FIG. 3 is a section corresponding to FIG. 2 in another rotor position.
Figure 4:
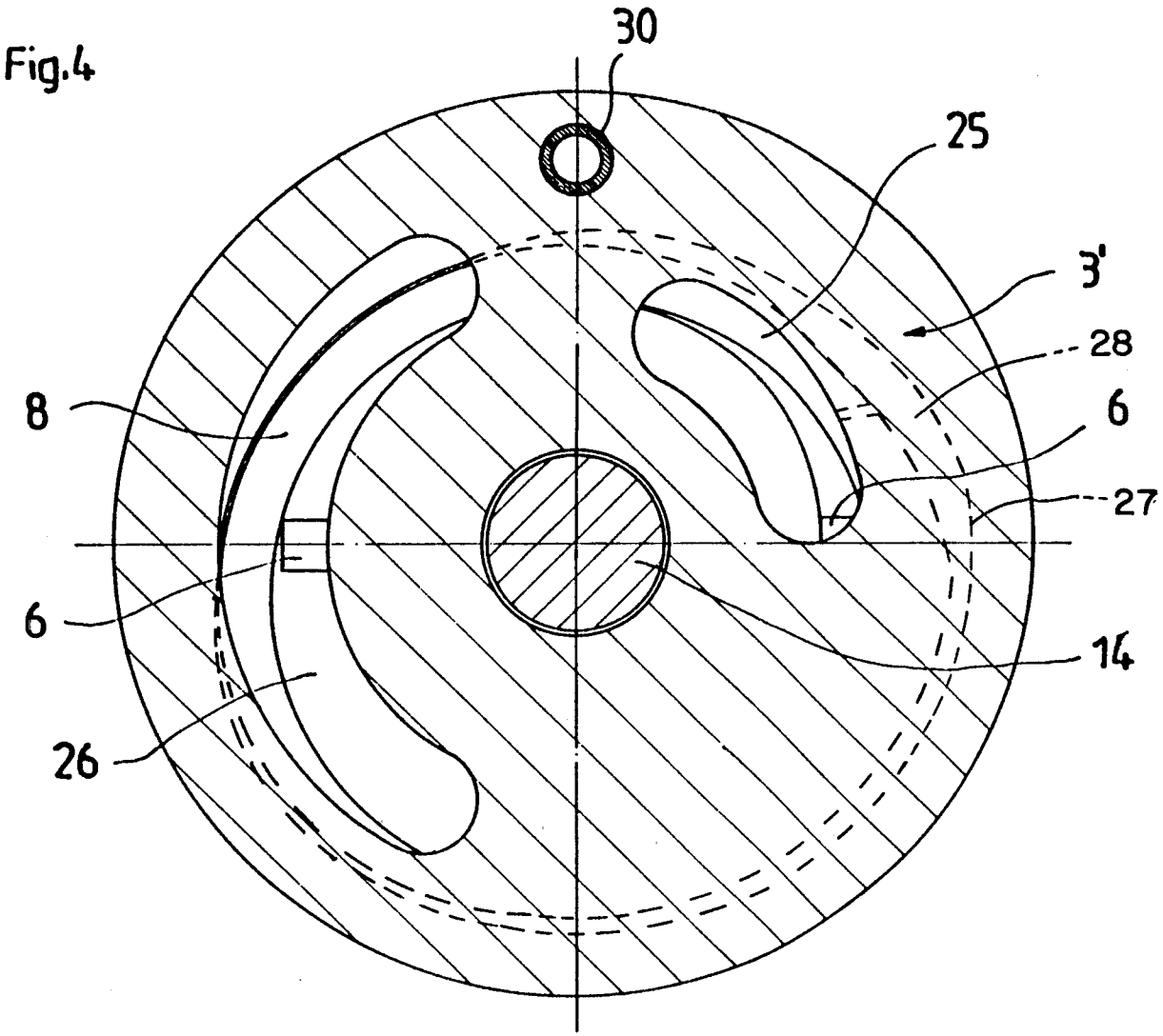
FIG. 4 is a cross-section along line IV—IV in FIG. 1 through a bearing part penetrated by the air-inlet channel and the air-outlet channel.

To achieve the above-stated objects, the invention makes provision for at least one air pocket to be provided in the housing toward the outer shell, the axial length of this air pocket corresponding to the axial length of the encircling outer shell so that, by the rotation, air is dragged along out of the air pocket and thus in practice a non-contact, highly vibration-dampened bearing arrangement of the outer shell in the housing is effected during operation. Shocks and vibrations which occur are dampened to a considerable extent by the specific design of the air-bearing arrangement so that, in an unexpected manner, wear hardly occurs any longer at all between the vanes and the outer shell even during oil-free operation, and a long service life is achieved.

The dragging along in particular of the air boundary layer is substantially facilitated by the transition or boundary area between the air pocket and the guide bore being of a rounded configuration in the peripheral direction.

High efficiency of the compressed-air vane motor can be achieved at low wear by providing that the cylindrical outer shell, is guided at the end faces with slight clearance between two sealing faces running perpendicularly to the rotational axis. To reduce friction further, the sealing face on the output shaft side can so as to rotate together with the rotor purpose can be formed expediently by disk firmly arranged on the rotor.

To simplify assembly and save weight, an end face 18 of the sealing disk 17 can bear against a shoulder of the rotor, this end face being able to serve partly as a sealing face. Furthermore, in a weight-saving manner the mating face 18 of the sealing disk 17 located opposite the sealing face can be part of an axial bearing for the rotor.

Furthermore, the sealing disk can have a collar which is restrained at the end face by the inner ring of the anti-friction bearing on the output shaft side so that a simple, space-saving construction with simple, if need be, automatic, assembly is achieved.

Simple dimensionally accurate production and assembly can be achieved by constructing the housing which encloses the rotor so that it has a cylinder part which is held at the end faces between two concentric bearing parts, these bearing parts axially guiding the rotor. The bearing part on the output side can be a ring having a radially inwardly projecting flat part, one side of the flat part having the mating face which interacts with the sealing disk. Furthermore, the bearing part on the output shaft side can have an axial outer collar which, at the end face, bears in alignment against the outer ring of the antifriction bearing.

The preferred exemplary embodiment shown in the appended figures shows a compressed-air vane motor having a rotor 1 which is rotatably mounted in and axially guided by bearing parts 3, 3' via anti-friction bearings 2, 2'. The rotor 1 is provided with four radial location slots 5 in which radially displaceable vanes 6 are accommodated. The vanes 6 have a rectangular shape and, with their sealing edges 4, they are pressed by centrifugal force against the cylindrical inner surface 7 of a tubular outer shell 8. This outer shell 8, displaced eccentrically relative to the rotational axis 9 of the rotor 1 is rotatably accommodated in a guide bore 10 of a housing 11. The housing 11 itself consists of a cylinder part 11', which is adjoined at its end faces with the bearing parts 3,3' which have a continuous cylindrical outer surface 12.

As shown in FIG. 1, the rotor 1, rotatable about the rotational axis 9, is connected to an output shaft 14 on which an inner ring 16 of the anti-friction bearing 2 is connected to a collar of sealing disk 17 via a clamping nut 15. The sealing disk 17 itself has a sealing face 18 which is directed perpendicularly to the rotational axis 9 and bears against a shoulder 19 of the rotor 1. The sealing disk 17 is rotatably accommodated at least partly between a flat part 20 of the bearing part 3 and the cylinder part 11' of the housing 11 so that the rotor 1 is axially guided.

An axial outer collar 21 of the bearing part 3 bears against the end face of the outer ring 22 of the anti-friction bearing 2. This outer ring 22 of the anti-friction bearing 2 runs in alignment with the outer surface 12 of the housing 11.

On the side opposite the output shaft 14, the rotor 1 is likewise provided with a radial shoulder 23 which interacts with a sealing face 24 of the bearing part 3'.

The outer shell 8 is rotatably guided with slight axial clearance between the sealing faces 18 and 24, which clearance extends perpendicularly to the rotational axis of the outer shell. Running in an axial direction, an air-inlet channel 25 and, roughly opposite over a wide peripheral area, an air-outlet channel 26 are provided in the bearing part 3. At least one of the air-inlet channel 25 and the air-outlet 26 opens in at least one of the sealing faces.

In operation, the rotor 1 is set in rotation in a manner known per se by the compressed air expanding and flowing through. The vanes 6 are pressed outwardly by centrifugal force against the inner surface 7 of the outer shell 8, and the outer shell 8 is rotated along with the vanes 6 in its guide bore 10 by friction.

In the exemplary embodiment, the guide bore 10 is widened on one side by a partial cylinder surface 27, and the intermediate space thus obtained serves as an air pocket 28 which is connected to the air-inlet channel 25. By rotation of the encircling outer shell 8, air and, in particular the boundary layer adhering to the surface of the outer shell 8, is dragged along out of the air pocket 28 into the remainder of the guide bore 10 so that, through the air cushion thus formed, a virtually non-contact bearing arrangement of the outer shell 8 results, by means of which the vibrations arising from the rotor 1 are damped. Thus, smooth, wear-free running is achieved. This enables the vane motor to be operated virtually free of wear by means of oil-free compressed air.

The bearing part 3' and the cylinder part 11' of the housing 11 are fixed against rotation in their mutual position by a pin 30 projecting into a slot 29.

Special centering measures are unnecessary when the cylindrical housing consisting of the cylindrical part and the two bearing parts is inserted in a location bore of the tool to be driven, in particular in a space-saving and weight-saving manner in the handle of the hand tool to be driven.

The mode of operation of the air bearing can be improved by the air pocket or air pockets being connected to the air-inlet channel, since, at higher air pressure, the boundary layers at the surfaces of the parts sliding against one another are thicker and are more capable of carrying load.

From the manufacturing point of view, the air pocket can be formed particularly advantageously by a partially cylindrical surface which is eccentric relative to the cylindrical guide bore and whose radius of curvature is smaller than or at most the same as the radius of curvature of the guide bore.

While the embodiment shown comprises a single air pocket 28, a plurality of such air pockets could be distributed over the periphery of the cylindrical guide bore 10.

Many changes and modifications within the scope of the present invention may be made without departing from the spirit thereof, and the invention includes all such modifications.

What is claimed is:

1. A compressed-air vane motor comprising:

(a) a housing having a generally cylindrical guide bore located therein;

(b) a rotor rotatably mounted on anti-friction bearings within said housing and having radially extending location slots distributed over the periphery thereof;

(c) a cylindrical outer shell eccentrically encircling said rotor and rotatably mounted within said guide bore via an air bearing comprising a slight radial clearance between an outer surface of said outer shell and said guide bore, wherein said guide bore is widened on only one side to form an air pocket between the housing and said outer surface of said cylindrical outer shell, and wherein the axial length of said air pocket corresponds to the axial length of said outer shell; and (d) vanes displaceably mounted in said location slots, wherein said vanes have outer sealing edges which are adapted to bear by centrifugal force against an inner surface of said outer shell and to rotate said outer shell within said guide bore due to frictional forces produced therebetween.

2. The compressed-air vane motor of claim 1, wherein a boundary area between said air pocket and said guide bore is of a rounded configuration in the peripheral direction.

3. The compressed-air vane motor of claim 1, wherein said outer shell has first and second axial end faces extending perpendicularly from the rotational axis thereof and which are guided with slight clearance between respective sealing faces of first and second sealing members, wherein at least one of an air-inlet channel and an air-outlet channel open out in at least one of said sealing faces, and wherein said air-inlet channel is connected to said air pocket.

4. The compressed-air vane motor of claim 3, wherein said first sealing member comprises a bearing part.

5. The compressed-air vane motor of claim 3, wherein said second sealing member is located proximate an output shaft side of said motor and rotates together with said rotor.

6. The compressed-air vane motor of claim 5, wherein said second sealing member comprises a sealing disk firmly attached to said rotor.

7. The compressed-air vane motor of claim 6, wherein a first end face of said sealing disk bears against a shoulder of said rotor and forms said sealing face of said second sealing member.

8. The compressed-air vane motor of claim 7, wherein a second end face of said sealing disk located opposite said sealing face forms part of an axial bearing for said rotor.

9. The compressed-air vane motor of claim 8, wherein said sealing disk has an axially extending collar, and wherein an inner ring of one of said anti-friction bearings bears against and restrains said collar.

10. The compressed-air vane motor of claim 3, wherein said first sealing member is located remote from an output shaft and extends radially inward to serve as an axial stop for a radial shoulder of said rotor.

11. The compressed-air vane motor of claim 3, wherein said rotor is rotatably mounted in and axially guided by first and second bearing parts.

12. The compressed-air vane motor of claim 11, wherein aid first baring part has an annular member having a flange projecting radially inwardly therefrom, and wherein one side of said flange has a mating face which abuts said second sealing member.

13. The compressed air-vane motor of claim 11, further comprising an anti-friction bearing which is disposed between said first bearing part and said rotor and which comprises an outer annular portion, and wherein said first bearing part has an axial outer collar which bears against said outer annular portion of said anti-friction bearing.

14. The compressed-air vane motor of claim 1, wherein said air pocket is formed by a partial cylindrical surface of said guide bore which is eccentric relative to the remainder of said guide bore, and which has a radius of curvature which is no greater than that of the remainder of said guide bore.

15. The compressed-air vane motor of claim 14, wherein the radius of curvature of said partial cylindrical surface is less than the radius of curvature of the remainder of the guide bore.

16. A compressed-air vane motor comprising:

(a) a housing having a generally cylindrical guide bore located therein;

(b) a rotor rotatably mounted on anti-friction bearings within said housing and having radially extending location slots distributed over the periphery thereof;

(c) cylindrical outer shell eccentrically encircling said rotor and rotatably mounted within said guide bore;

(d) means for providing an air bearing between said outer shell and said guide bore, said means for providing a slight clearance formed between said outer shell and a peripheral surface of said guide bore;

(e) means for supplying air to said means for providing an air bearing, said means for supplying comprising an air pocket located on one side of said guide bore, whereby said rotor drags air out of said air pocket and into said slight clearance to form said air bearing; and (f) vane means, displaceably mounted in each of aid location slots, for engaging said outer shell and for rotating said outer shell within said guide bore due to frictional forces produced between said vane means and said outer shell.

17. The compressed-air vane motor of claim 16, wherein each of said vane means has side faces which are rectangular in shape and wherein each of said vane means has a sealing edge which extends transversely of said side faces and which engages an inner surface of said outer shell.

18. The compressed-air vane motor of 16, wherein aid outer shell has axial end faces extending perpendicularly from the rotational axis thereof and which are guided with slight axial clearance between respective sealing faces of first and second sealing members, wherein at least one of an air-inlet channel and an air-outlet channel open out in at least one of said sealing faces, and wherein said air-inlet channel is connected to said air pocket.

19. The compressed-air vane motor of claim 16, wherein aid means for supplying air consists of a single air pocket.

20. The compressed-air vane motor of claim 16, wherein aid air pocket is formed by a partial cylindrical surface of said guide bore which is eccentric relative to the remainder of said guide bore and which has a radius of curvature which is not greater than that of the remainder of said guide bore.

21. The compressed-air vane motor of claim 20, wherein the radius of curvature of said partial cylindrical surface is less than the radius of curvature of the remainder of the guide bore.

* * * * *